US006520661B1

(12) United States Patent
Hill

(10) Patent No.: US 6,520,661 B1
(45) Date of Patent: Feb. 18, 2003

(54) DECORATIVE LIGHT ASSEMBLY

(76) Inventor: Sharon K. Hill, 6708 Havenoak Rd., Apt B-3, Baltimore, MD (US) 21237

( * ) Notice: Subject to any disclaimer, the term of this patent is extended or adjusted under 35 U.S.C. 154(b) by 0 days.

(21) Appl. No.: 10/051,028

(22) Filed: Jan. 18, 2002

(51) Int. Cl.[7] ..... F21V 21/08
(52) U.S. Cl. ..... 362/252; 362/249; 362/327
(58) Field of Search ..... 362/249, 252, 362/327, 806, 397, 398, 396

(56) References Cited

U.S. PATENT DOCUMENTS

| | | | | | |
|---|---|---|---|---|---|
| D218,615 | S | | 9/1970 | Adler | |
| 4,244,014 | A | | 1/1981 | Van Ess | 362/249 |
| 4,774,646 | A | | 9/1988 | L'Heureux | 362/249 |
| 4,795,121 | A | * | 1/1989 | Comito | 362/806 |
| 4,901,960 | A | | 2/1990 | Gary | 362/249 |
| 5,142,461 | A | * | 8/1992 | Nugent | 362/806 |
| 5,311,414 | A | | 5/1994 | Branham, Sr. | 362/249 |
| 5,359,506 | A | * | 10/1994 | Koleno | 362/248 |
| 5,513,081 | A | * | 4/1996 | Byers | 362/806 |
| 5,788,362 | A | * | 8/1998 | Chou | 362/806 |
| 5,873,651 | A | | 2/1999 | Hofer et al. | 362/396 |

* cited by examiner

*Primary Examiner*—Laura K. Tso

(57) ABSTRACT

A decorative light assembly for selective attachment to a wide variety of surfaces. The decorative light assembly includes a plurality of base members. Each has a top wall, a back wall, and a pair of side walls that are attached to and extend away from the top wall. A plurality of illumination devices are fixedly coupled to an upper surface of each of the top walls. A plurality of mounting plates selectively couple each of the illumination devices to a ferromagnetic surface. A plurality of attachment plates selectively coupling each of the mounting plates to a non-ferromagnetic surface has a first side and a second side. An attachment means is coupled to each of the second sides of the attachment plates.

12 Claims, 5 Drawing Sheets

DECORATIVE LIGHT ASSEMBLY

BACKGROUND OF THE INVENTION

1. Field of the Invention

The present invention relates to decorative lights and more particularly pertains to a new decorative light assembly for selective attachment to a wide variety of surfaces.

2. Description of the Prior Art

The use of decorative lights is known in the prior art. U.S. Pat. No. 5,873,651 describes a miniature light base and connector. Another type of decorative lights is U.S. Pat. No. 5,311,414 having an elongate housing structure have a base plate, a first planar cover plate and a second V-shaped cover plate hingedly mounted to the first planar cover plate to selectively provide viewing of Christmas tree sockets and bulbs for permanent mounting relative to an exterior surface of a dwelling.

While these devices fulfill their respective, particular objectives and requirements, the need remains for a system that attaches and detaches to a variety of surfaces.

SUMMARY OF THE INVENTION

The present invention meets the needs presented above by providing a universal mounting base that incorporates numerous types of mounting methods.

Still yet another object of the present invention is to provide a new decorative light assembly that utilizes magnets for ease of mounting to metal surfaces.

Even still another object of the present invention is to provide a new decorative light assembly that can be mounted to different types of surfaces from one light to the next.

To this end, the present invention generally comprises a plurality of base members. Each has a top wall, a back wall, and a pair of side walls that are attached to and extend away from the top wall. A plurality of illumination devices are fixedly coupled to an upper surface of each of the top walls. A plurality of mounting plates selectively couple each of the illumination devices to a ferromagnetic surface. A plurality of attachment plates selectively coupling each of the mounting plates to a non-ferromagnetic surface has a first side and a second side. An attachment means is coupled to each of the second sides of the attachment plates.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
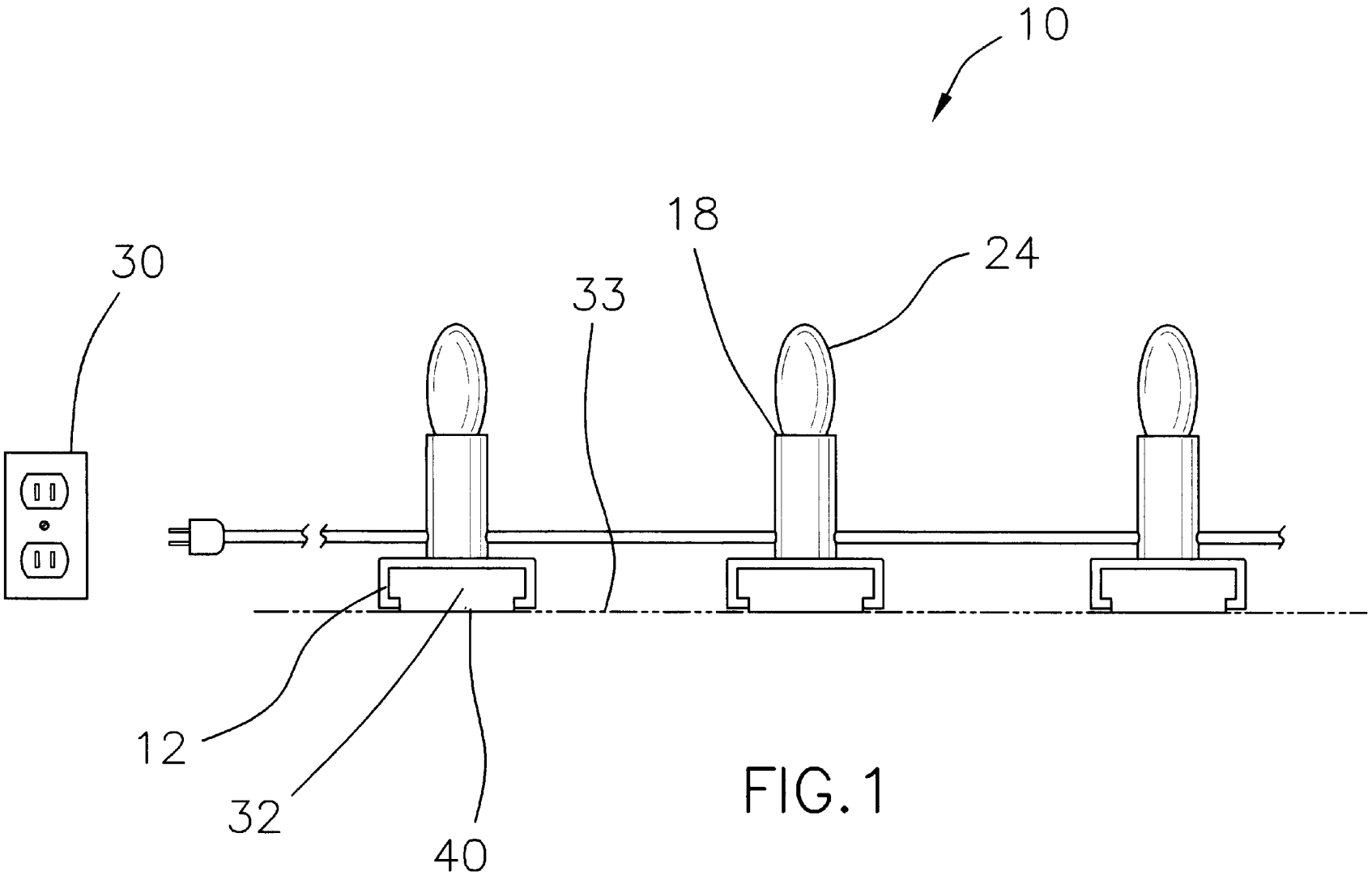
FIG. 1 is a schematic front view of a new decorative light assembly according to the present invention.
Figure 2:
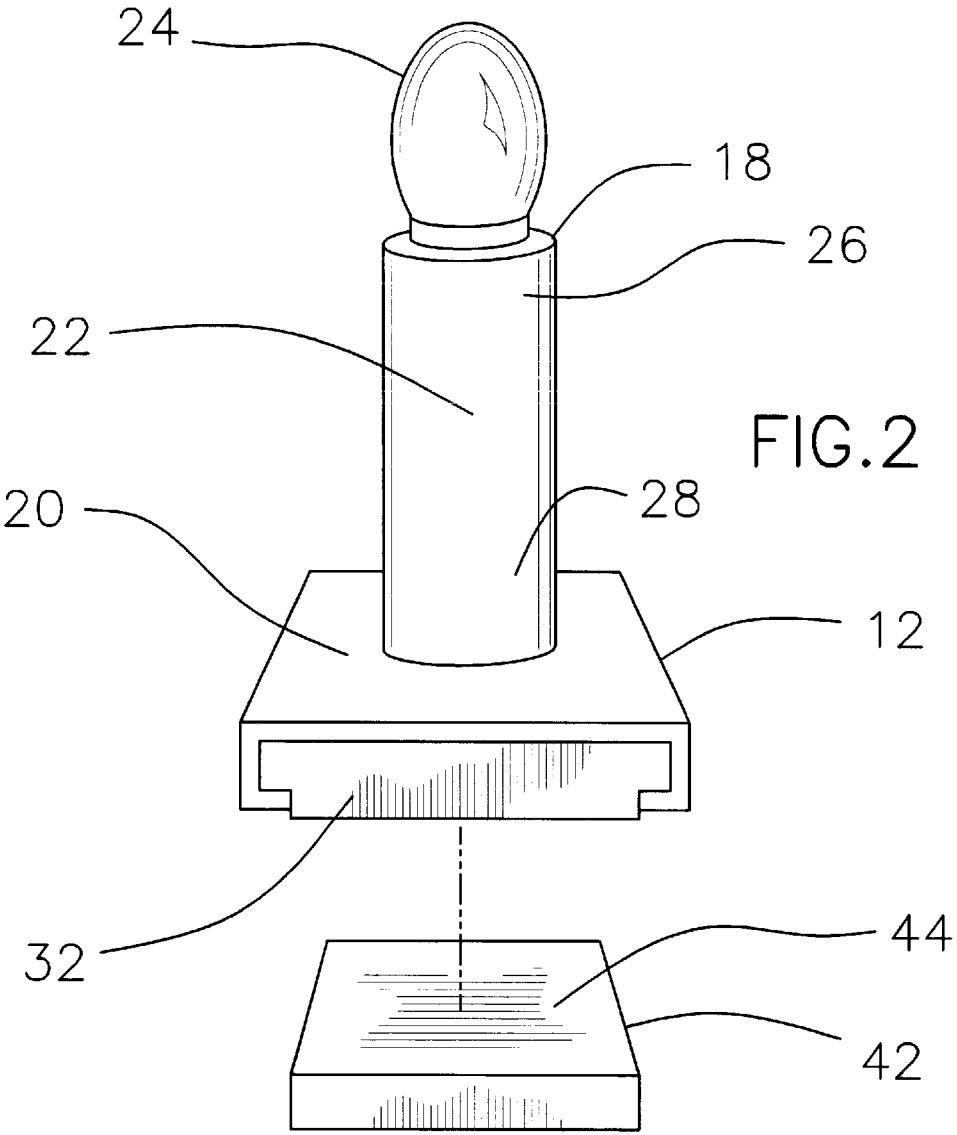
FIG. 2 is a schematic a top perspective view of a single illumination device and the mounting means of the present invention.
Figure 3:
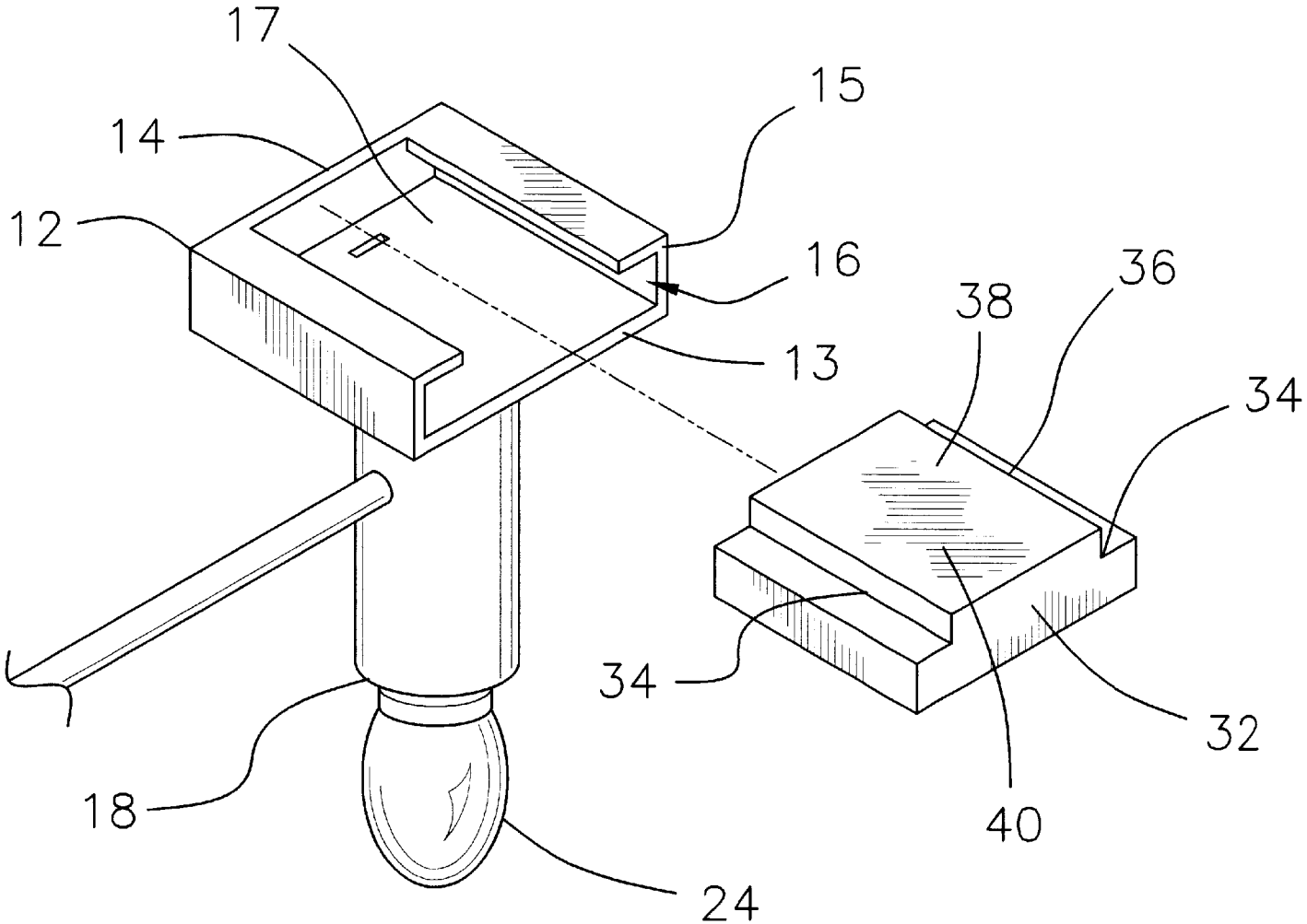
FIG. 3 is schematic bottom perspective view of the present invention.
Figure 4:
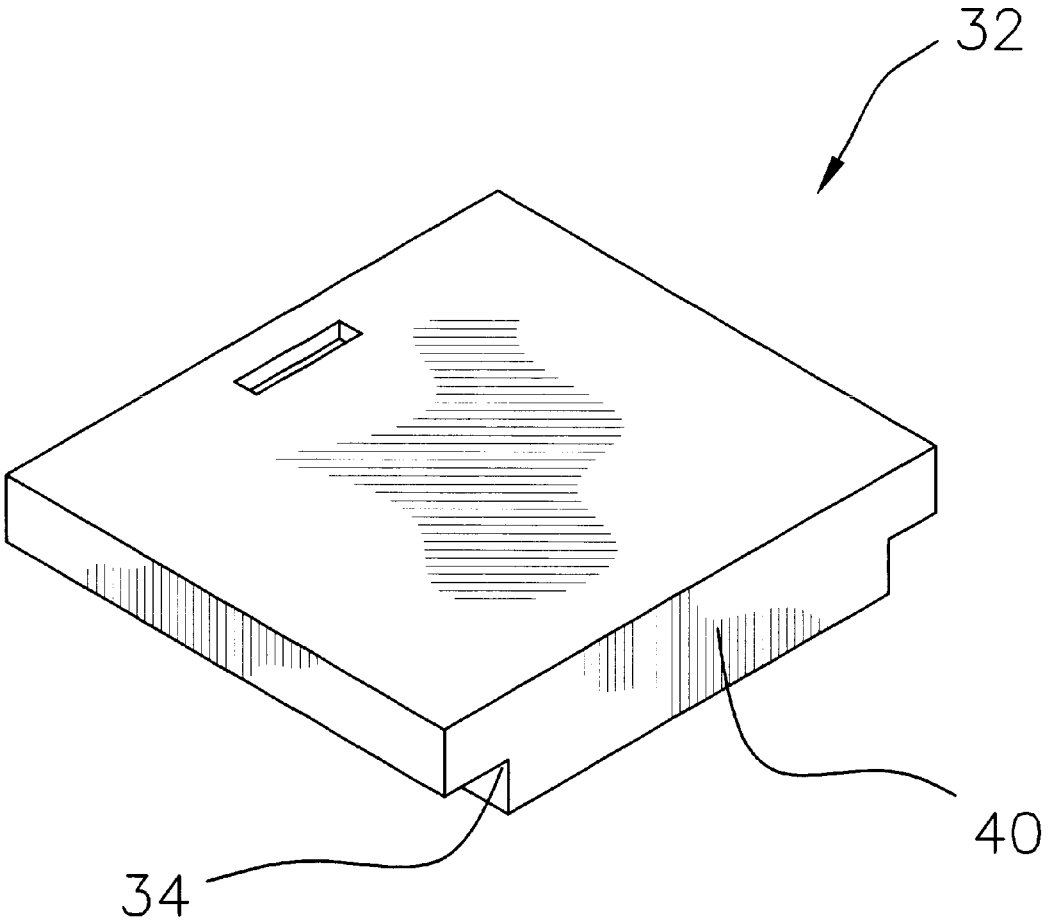
FIG. 4 is a schematic perspective view of the mounting plate of the present invention.
Figure 5:
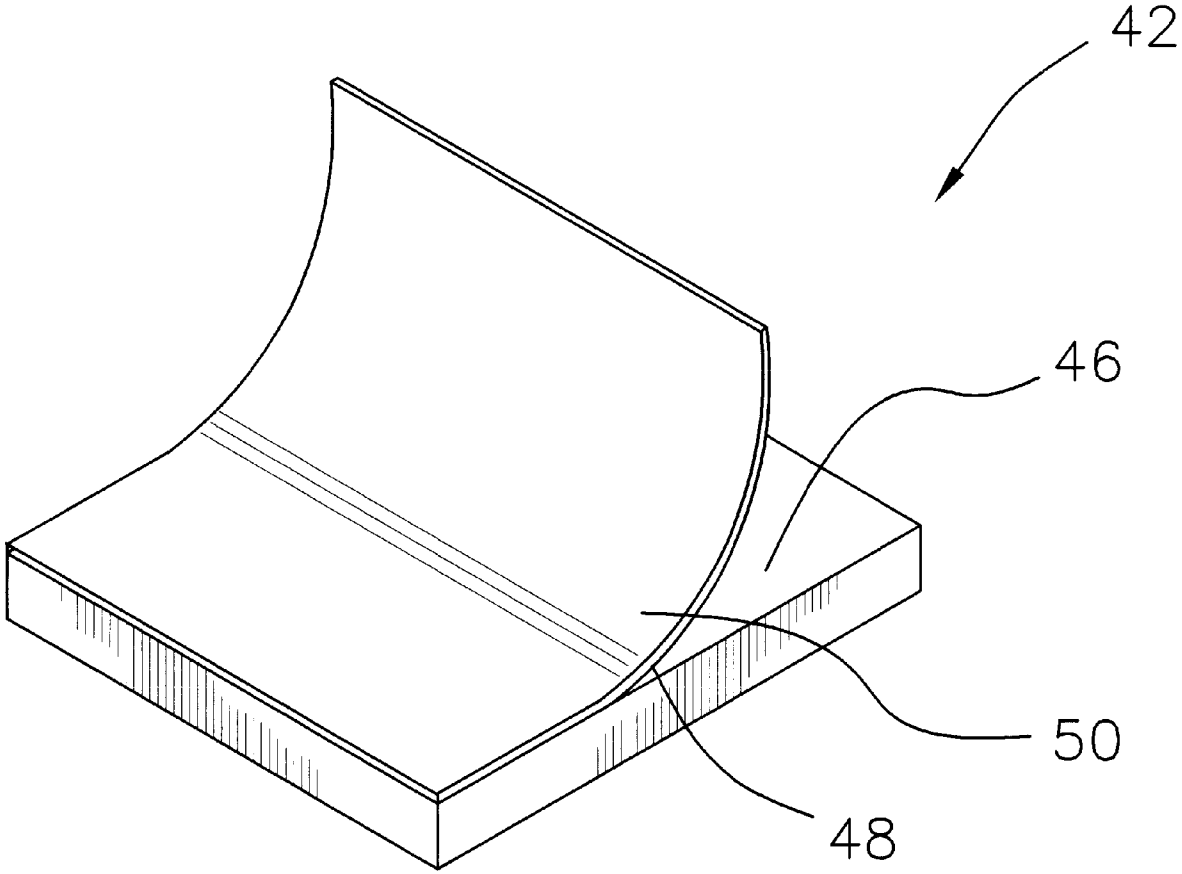
FIG. 5 is a schematic perspective view of the attachment plate of the present invention.

With reference now to the drawings, and in particular to FIGS. 1 through 5 thereof, a new decorative light assembly embodying the principles and concepts of the present invention and generally designated by the reference numeral 10 will be described.

As best illustrated in FIGS. 1 through 5, the decorative light assembly 10 generally comprises a plurality of base members 12 each having a top wall 13, a back wall 14, and a pair of side walls 15 attached to and extending away from the top wall 13. Each of the side walls 15 are generally L-shaped such that a channel 16 has a C-shape is formed in a bottom side 17 of each of the base members 12.

A plurality of illumination devices 18 is fixedly coupled to an upper surface 20 of each of the top walls 13. Each of the illumination devices 18 includes an elongate post 22 and a bulb 24. Each of the posts 22 has a top end 26 and a bottom end 28. The bottom ends 28 are attached to the top walls 13. Each of the bulbs 24 is releasably attachable to each of the top ends 26. Each of the illumination devices 18 are electrically coupled together such that each of the bulbs 24 illuminates when electrically coupled to a power source 30. Each of the illumination devices 18 are spaced apart an equal distance from each other.

A plurality of mounting plates 32 for selectively coupling each of the illumination devices 18 to a ferromagnetic surface 33 is included.

Each of the mounting plates 32 has a pair of notches 34 located adjacent outer edges 36 of a lower side 38 of each of the mounting plates 32 such that each of the mounting plates 32 are removably positionable in the channel 16 of each of the base members 12. A middle portion 40 of the lower side 38 of each of the mounting plates 32 extending outwardly beyond each of the side walls 15 when positioned in one of the base members 12. Each of the mounting plates 32 comprises a magnet.

A plurality of attachment plates 42 for selectively coupling each of the mounting plates 32 to a non-ferromagnetic surface has a first side 44 and a second side 46. The first sides 44 of each of the attachment plates comprise a ferromagnetic material such that each of the attachment plates may be releasably attached to the middle portion 40 of the lower side 38 of each of the mounting plates 32.

An attachment means 48 are coupled to each of the second sides 46 of the attachment plates. The attachment means 48 is adhesive tape 50.

In this disclosure, only a single attachment means, adhesive tape is depicted. It is obvious that any number of methods or devices, such as hooks, suction cups, or fasteners could be implemented in this design.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A decorative light assembly for selective attachment to a metal surface, said assembly comprising:

a plurality of base members each having a top wall, a back wall, and a pair of side walls attached to and extending away from said top wall;

a plurality of illumination devices, each of said illumination devices being fixedly coupled to an upper surface of each of said top walls;

a plurality of mounting plates for selectively coupling each of said illumination devices to a ferromagnetic surface;

a plurality of attachment plates for selectively coupling each of said mounting plates to a non-ferromagnetic surface having a first side and a second side; and an attachment means being coupled to each of said second sides of said attachment plates.

2. The decorative lights as set forth in claim 1, further comprising each of said side walls being generally L-shaped such that a channel having a C-shape is formed in a bottom side of each of said base members.

3. The decorative lights as set forth in claim 1, further comprising each of said illumination devices including an elongate post and a bulb.

4. The decorative lights as set forth in claim 3, further comprising each of said posts having a top end and a bottom end, wherein said bottom ends are attached to said top walls.

5. The decorative lights as set forth in claim 3, further comprising each of said bulbs being releasably attachable to each of said top ends, each of said illumination devices being electrically coupled together such that each of said bulbs illuminates when electrically coupled to a power source.

6. The decorative lights as set forth in claim 1, further comprising each of said illumination devices being spaced apart an equal distance from each other.

7. The decorative lights as set forth in claim 2, further comprising each of said mounting plates having a pair of notches located adjacent outer edges of a lower side of each of said mounting plates such that each of said mounting plates are removably positionable in said channel of each of said base members.

8. The decorative lights as set forth in claim 7, further comprising a middle portion of said bottom side of each of said mounting plates extending outwardly beyond each of said side walls when positioned in one of said base members.

9. The decorative lights as set forth in claim 1, further comprising each of said mounting plates comprising a magnet.

10. The decorative lights as set forth in claim 8, further comprising said first sides of each of said attachment plates comprising a ferromagnetic material such that each of said attachment plates may be releasably attached to said middle portion of said bottom side of each of said mounting plates.

11. The decorative lights as set forth in claim 1, wherein said attachment means being selected from the group consisting of adhesive tape, suction cups, and hook and loop fasteners.

12. A decorative light assembly for selective attachment to a metal surface, said assembly comprising:

a plurality of base members each having a top wall, a back wall, and a pair of side walls attached to and extending away from said top wall, each of said side walls being generally L-shaped such that a channel having a C-shape is formed in a lower side of each of said base members;

a plurality of illumination devices, each of said illumination devices being fixedly coupled to an upper surface of each of said top walls, each of said illumination devices including an elongate post and a bulb, each of said posts having a top end and a bottom end, wherein said bottom end are attached to said top walls, each of said bulbs being releasably attachable to each of said top ends, each of said illumination devices being electrically coupled together such that each of said bulbs illuminates when electrically coupled to a power source, each of said illumination devices being spaced apart an equal distance from each other;

a plurality of mounting plates for selectively coupling each of said illumination devices to a ferromagnetic surface, each of said mounting plates having a pair of notches located adjacent outer edges of a lower side of each of said mounting plates such that each of said mounting plates are removably positionable in said channel of each of said base members, a middle portion of said lower side of each of said mounting plates extending outwardly beyond each of said side walls when positioned in one of said base members, each of said mounting plates comprising a magnet;

a plurality of attachment plates for selectively coupling each of said mounting plates to a non-ferromagnetic surface having a first side and a second side, said first sides of each of said attachment plates comprising a ferromagnetic material such that each of said attachment plates may be releasably attached to said middle portion of said lower side of each of said mounting plates;

an attachment means being coupled to each of said second sides of said attachment plates, wherein said attachment means being selected from the group consisting of adhesive tape, suction cups, and hook and loop fasteners.

* * * * *